US007021628B2

(12) United States Patent
Reynolds

(10) Patent No.: US 7,021,628 B2
(45) Date of Patent: Apr. 4, 2006

(54) MULTIPLE PLAYER BOARD GAMES

(76) Inventor: Kevin L. Reynolds, 319 S. 300 E, Monticello, IN (US) 47960

( * ) Notice: Subject to any disclaimer, the term of this patent is extended or adjusted under 35 U.S.C. 154(b) by 0 days.

(21) Appl. No.: 10/807,445

(22) Filed: Mar. 24, 2004

(65) Prior Publication Data

US 2005/0212209 A1 Sep. 29, 2005

(51) Int. Cl.
*A63F 3/00* (2006.01)

(52) U.S. Cl. ..... 273/260; 273/261

(58) Field of Classification Search ..... 273/260, 273/261; D21/348

See application file for complete search history.

(56) References Cited

U.S. PATENT DOCUMENTS 3,610,626 A * 10/1971 Nolte ..... 273/261
4,778,187 A 10/1988 Deak, Jr.
4,932,669 A 6/1990 Perry
D340,953 S 11/1993 Langlotz
5,586,762 A 12/1996 Wearley
5,690,334 A 11/1997 Duke
5,692,754 A 12/1997 Rostami
6,116,602 A 9/2000 McLoy
2002/0167129 A1 11/2002 Stanton

FOREIGN PATENT DOCUMENTS

GB 1030519 5/1966
GB 2203660 10/1988

* cited by examiner

*Primary Examiner*—Vishu K. Mendiratta
(74) *Attorney, Agent, or Firm*—Richard C. Litman

(57) ABSTRACT

A game board includes a square central playing area having a relatively large number of playing positions thereon, with each edge of the central playing area having two matrices of three rows and eight columns of playing positions extending therefrom. These playing position extensions provide for the initial placement of conventional chess or checker playing pieces thereon at the beginning of multiple player games, and permit play by up to eight players. The initial playing position extensions are colored differently from one another over the lighter colored squares of the alternating dark and light colored playing positions, with the playing pieces assigned to each starting position being similarly colored. Rules are for the most part similar to conventional chess and checker rules, but allow chess pawns and checkers to make larger moves than in conventional play in order to compensate for the larger central playing area of the board.

11 Claims, 6 Drawing Sheets

10
12
28
40
42
R
Kt
B
K
Q
B
Kt
R
P
P
P

MULTIPLE PLAYER BOARD GAMES

BACKGROUND OF THE INVENTION

1. Field of the Invention

The present invention relates generally to board games, and more particularly to chess- and checker-like board games and a game board for play of those games. The present games are similar to the games of chess and checkers, but the game board and rules allow for play by from two to eight persons, as desired.

2. Description of the Related Art

Board games have been popular leisure time activities for centuries. For example, the game of chess was originally developed in India, on the order of 2500 years ago. The game of checkers may go back even further. However, the classic, conventional games of chess and checkers permit play by only two persons at a time, from opposite sides of the square board.

However, the play of a conventional game of chess or checkers often seems to draw spectators who oftentimes offer suggestions or advice, in addition to merely observing the progress of the game. Such kibitzers are universally known as an adjunct of two person games, particularly board games in which the observation of the progress of play from both players is clearly observable by all who wish to take note of the game.

Clearly, some modification of the classic, conventional games of chess and checkers to allow play by more than two persons is desirable. The present invention responds to this need by providing chess-like and checker-like board games, and a game board for the play thereof, which allow from two to eight persons to play the selected game simultaneously, competing against one another. The present games are closely related to the conventional games of chess and checkers, but are modified to allow simultaneous play by more than two players across the larger playing area provided. The present game board includes a square central playing area, but further includes two starting areas along each of the four sides of the board, permitting up to eight players to participate simultaneously.

A discussion of the related art of which the present inventor is aware, and its differences and distinctions from the present invention, is provided below.

U.S. Pat. No. 4,778,187 issued on Oct. 18, 1988 to Joseph W. Deak, Jr., titled "Modified Chess Game Method Of Play," describes a chess-like board game providing for up to four players, with each player controlling playing pieces initially arrayed along a starting extension along each of the four sides of the board. The central portion of the Deak, Jr. game board comprises a matrix of only eight by eight squares, identical to the board configuration of a classical chess or checkerboard. This provides room for only one set of playing pieces along each side of the board, thus permitting a maximum of only four players to play. The present game board, with its central playing area of eighteen by eighteen positions, provides sufficient room along each edge for two sets of playing pieces with two spaces or positions between the sets along each side. Thus, up to eight players may play simultaneously using the present game. Moreover, the present invention also provides for the play of a checker-like game; Deak, Jr. does not disclose any form of a checker-like game.

U.S. Pat. No. 4,932,669 issued on Jun. 12, 1990 to John T. Perry, titled "Method Of Playing A Multiple Player Chess Game," describes a chess-like game for up to four players, with one set of playing pieces arrayed along each of the four sides of the board for four players. As in the game and game board of the '187 U.S. patent to Deak, Jr. discussed immediately above, the Perry game board includes only an eight by eight matrix of playing positions in the center of the board. This provides room for only a single set of playing pieces, and thus a single player, along each side or edge of the board for the Perry game. The present game and game board, with its considerably greater number of playing positions in the board center, provides two separate initial playing areas for setting up two separate sets of playing pieces along each side or edge. Moreover, the present game also provides for the play of a checkers-like game for up to eight players, using the two starting positions per side provided on the game board of the present invention. Perry makes no disclosure of the play of any other game than a game closely resembling chess, in his disclosure.

U.S. Pat. No. 5,586,762 issued on Dec. 24, 1996 to Jon P. Wearley, titled "Method Of Playing A Quadrilateral Chess Game," describes two different game boards providing for the play of chess or checkers by up to four persons. The game boards each include single starting extensions along each of the four sides, with the chess board having extensions which are two rows deep and the checker board having extensions which are three rows deep in order to accommodate the initial starting array for checkers. Wearley modifies his game board by providing promotion lines thereon, in order that pawns or checkers need not be advanced further than in conventional chess or checkers for promotion. In contrast, the present game board includes a considerably larger central playing area of eighteen by eighteen squares, with two initial positions along each edge of the board. Rather than modifying the board to permit play using conventional moves, the present game modifies the movement of certain pieces for both chess and checkers, in order to avoid unduly long travel across the larger board.

U.S. Pat. No. 5,690,334 issued on Nov. 25, 1997 to George W. Duke, titled "Expanded Chess-Like Game," describes a two person game played on a slightly expanded board having eight rows and ten columns or files. Two additional pieces are provided, which have moves unlike conventional chess pieces. Duke makes no provision for more than two players, as his board cannot accommodate multiple player initial positions along all four sides, as can the present chess-like game. Also, Duke makes no mention of any checkers-like game in his disclosure.

U.S. Pat. No. 5,692,754 issued on Dec. 2, 1997 to Ali R. Rostami, titled "Advanced Chess Game And Method Therefor," describes a chess-like game having a laterally expanded board to ten positions wide, essentially identical to the board of the '334 U.S. patent to Duke, discussed immediately above. Rostami provides two additional four additional pieces of two types per player, to fill out the two rows of ten positions each comprising the starting positions of his game. However, due to the relatively shallow depth of the board, i.e. having only eight rows, no provision is made by Rostami for the addition of any further players playing from positions along the sides of the board. The Rostami game thus more closely resembles the game of the Duke '334 U.S. patent, than it does the present game or games.

U.S. Pat. No. 6,116,602 issued on Sep. 12, 2000 to Mackie C. McLoy, titled "Enhanced Four Handed Variation Of Chess," describes a chess-like game employing additional pieces having different moves than conventional chess pieces, in addition to the conventional chess pieces. The McLoy game board includes four initial positions, with one along each edge of the square board. Pawns may initially move up to three positions, in order to advance play across the larger than standard board. However, the McLoy game board only provides for a single set of playing pieces, and single player, along each side of the board. In contrast, the present multiple player game allows two players along each side of the board, for up to eight players. Moreover, McLoy makes no disclosure of a checkers-like game.

U.S. patent Publication Ser. No. 2002/167,129 published on Nov. 14, 2002, titled "Modular Board Game Apparatus," describes a number of embodiments of game boards having alternating patterns of positions in their rows and columns. The Stanton game boards are not true checkerboards, in that they do not have a square configuration. Rather, they are distorted to alter their shapes, and the shapes of the individual positions, to other than square. Some of the boards are altered by distorting the positions to provide their separation along radial or diagonal lines, thereby providing separate sides for the placement of playing pieces by more than two players. Stanton also provides certain specialized rules for chess to go with his multiple player game boards, but is silent regarding any specialized rules for checkers, which would appear to be necessary considering the non-square configuration of his boards. In any event, the '129 publication does not provide any game board configurations permitting multiple players and playing positions along each side or edge of the board, as is done with the present multiple player games.

U.S. Des. Pat. No. 340,953 issued on Nov. 2, 1993 to Ronald A. Langlotz, titled "Game Board," illustrates a design for a folding square board having an eight by eight matrix of positions in the center, with a folding wing of two rows extending from each side. Each folding wing can accommodate only one set of chess pieces, for a maximum of only four players. No playing pieces or rules of play are disclosed in the Langlotz game board design.

British Patent Publication No. 1,030,519 published on May 25, 1966, titled "Board Games," describes another four player chess-like game in which the board has an extension along each of its four sides for the initial placement of the playing pieces. The '519 game requires a partnership of two players against two other players, unlike the present game. The '519 publication provides different rules for the movement of the pawns, in which they cannot be moved toward the side of the board along which one's partner's playing pieces are initially placed. While the present game also adjusts the pawn moves in order to accelerate progress across its larger board, the present game also provides for twice the number of players as the '519 game.

Finally, British Patent Publication No. 2,203,660 published on Oct. 26, 1988, titled "Board Game," describes a game having an eight-by-eight central matrix of positions, with a four-by-eight matrix extending from each side. The '660 game is played in two stages, with the first stage involving the placement of various segments on the board to represent different terrain features, and the second stage involving the movement of playing pieces over the terrain segments. The '660 publication provides for up to four players, but the playing pieces are intended to simulate military movement, rather than being closely related to the movement of chess pieces.

None of the above inventions and patents, taken either singly or in combination, is seen to describe the instant invention as claimed. Thus multiple player chess- and checker-like board games solving the aforementioned problems are desired.

SUMMARY OF THE INVENTION

The present multiple player board games are played using a considerably larger board than the conventional eight-by-eight matrix of sixty-four square positions used in conventional chess and checker game boards. The game board of the present invention comprises a square central playing area of eighteen-by-eighteen positions, with each side of the square having two initial playing areas of three-by-eight positions. This provides a total of eight initial playing areas about the four sides of the board, allowing up to eight players to play simultaneously.

The game board of the present invention may be used to play a game based closely on the rules of conventional chess. Each player controls a conventional set of chess pieces, initially placed upon his or her starting area. Playing pieces move conventionally, with the exception of the pawns which are provided with additional moves to accelerate play across the larger than conventional board. Lateral moves are permitted for pawns as well, enabling them to reach opponents' areas along the sides of the boards for promotion once crossing the center of the board.

The present game board may also be used to play a checker-like game, as well. The checkers are permitted to make extended moves, much like the pawns in the chess-like game, in order to advance more quickly across the larger board. Play is otherwise much like conventional checkers, with the last player having a checker or checkers on the board winning the game.

These and other features of the present invention will become readily apparent upon review of the following specification and drawings.

BRIEF DESCRIPTION OF THE DRAWINGS

Similar reference characters denote corresponding features consistently throughout the attached drawings.

DETAILED DESCRIPTION OF THE PREFERRED EMBODIMENTS

Figure 1:
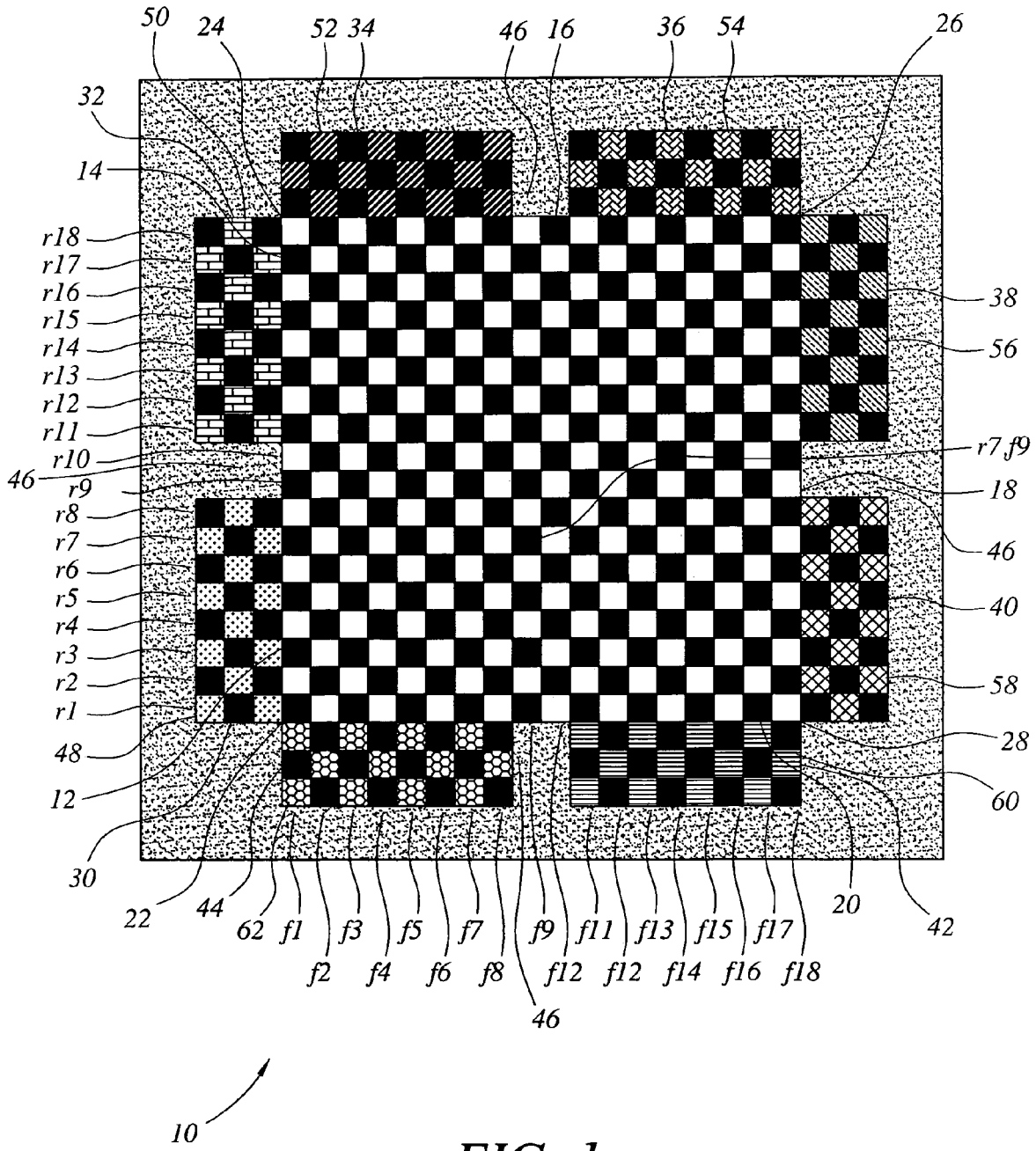
FIG. 1 is a top plan view of the game board for the multiple player chess- and checker-like board games of the present invention, showing its general configuration and different color patterns of the initial playing extension areas.

The present invention comprises different embodiments of multiple player chess- and checker-like board games playable on a game board common to both games. FIG. 1 provides a top plan view of the game board 10 of the present invention. The game board 10 comprises a square central playing area 12 having four sides 14 through 20 and four corners 22 through 28 containing a matrix of eighteen horizontal ranks or rows, designated as r1 through r18, by eighteen vertical files or columns, designated as f1 through f18, for a total of three hundred and twenty four playing positions. Each individual playing position may be designated by some combination of the above rank and file designators, e.g. r7,f9 as indicated in FIG. 1 for the playing position of the seventh row or rank and of the ninth column or file.

Each of the sides 14 through 20 of the board 10 has a pair of initial playing extensions extending outwardly therefrom, designated as extensions 30 through 44, clockwise around the board 10 of FIG. 1 from the lower left extension 30. Each of the extensions 30 through 44 comprises twenty four playing positions formed of a series of three ranks or rows aligned with the respective side or edge of the board, and eight files extending normal to the respective edge of the board. The three ranks of each extension 30 through 44 provides sufficient depth for the placement of three staggered rows of checkers or two rows of chess pieces upon each extension, as is conventional at the respective beginning of a checker or chess game.

Each of the extensions 30 through 44 has an outer lateral edge immediately adjacent to its respective central playing area corner 22 through 28. As each extension 30 through 44 spans only eight playing positions and each edge or side 14 through 20 of the board 10 spans eighteen playing positions, the placement of the extensions 30 through 44 results in a gap or space 46 between each of the extensions along any given edge, e.g. extensions 34 and 36 along the side or edge 16. Each of the extension gaps 46 has a width equivalent to two playing positions on the central area 12 of the board 10, as the total width of the two extensions along any given edge of the board is two playing positions less than the total span of the board along each edge thereof.

The playing positions of both the central area 12 and of the eight extensions 30 through 44 are formed of alternating lightly and darkly colored positions in a checkerboard pattern or array, as is clear from FIG. 1. The central area 12 may comprise alternating black and white squares, or other contrasting colors as desired. The darker squares or positions of the extensions 30 through 44 are preferably of the same color and/or shading as the darker squares of the central playing area 12. However, the lighter colored squares of the extensions 30 through 44 are colored, shaded, or otherwise marked to differentiate the extensions from one another. For example, all of the lighter positions 48 of the first extension 30 may be colored light green, with the lighter positions of the other extensions 32 through 44 respectively colored lavender, purple, red, light blue, dark green, orange, and yellow.

The above colors are merely exemplary, and are not mandatory or essential to the operation of the present invention. The key point here is that the lighter shaded playing positions of the eight extensions be uniformly marked or colored throughout each extension, but that the colors or markings be different between different extensions, as indicated by the symbolic markings on the lighter positions of the extensions 30 through 44 on the game board 10 in FIG. 1. Other colors, textures, symbols, etc. may be used to differentiate the lighter playing positions of each extension from one another, as desired.

Figure 2:
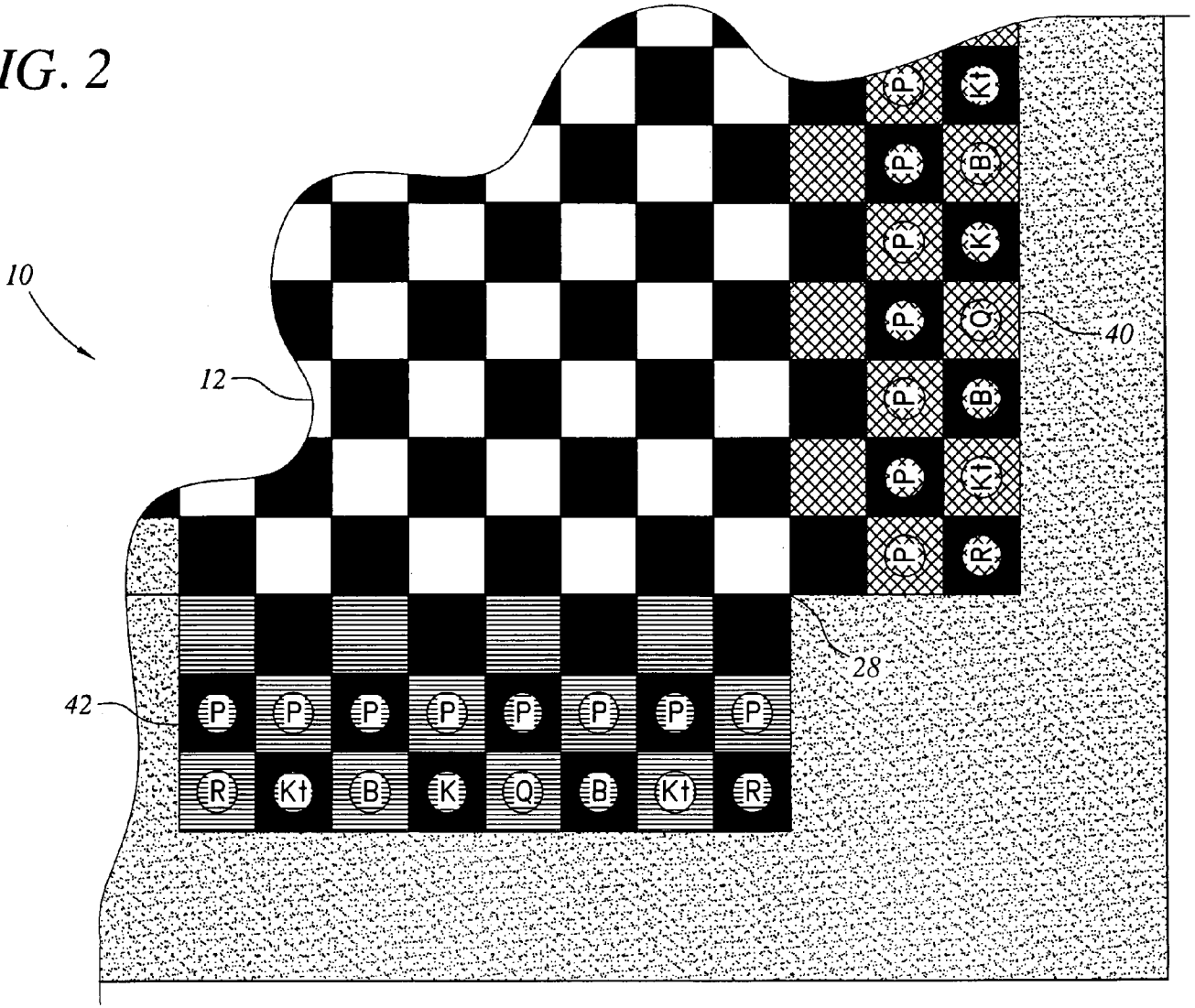
FIG. 2 is a broken away portion of the game board of FIG. 1, showing the placement of chess pieces in the initial playing extension areas thereof at the beginning of a chess game.

FIG. 2 provides a broken away detail of the lower right corner 28 area of the board 10, showing the placement of conventional chess sets on the extensions 40 and 42 immediately adjacent the corner 28. Chess is conventionally played using sixteen pieces per player, comprising a king K, queen Q, two bishops B, two knights Kt, two rooks R, and eight pawns P arranged in the two outermost opposing rows of a game board. The present chess-like game places a conventional set of chess pieces along the two outermost rows of each extension 30 through 44, or upon as many extensions as there are players, up to eight players corresponding to the eight extensions 30 through 44. Each set of chess pieces is identically colored or marked in each set, to match the color or marking of the lighter colored positions of the extension to which it corresponds. Thus, the extension 40 having its lighter positions colored green is assigned the green chess set, the next extension 42 having orange colored lighter positions has the orange chess set placed thereon, etc.

Figure 3:
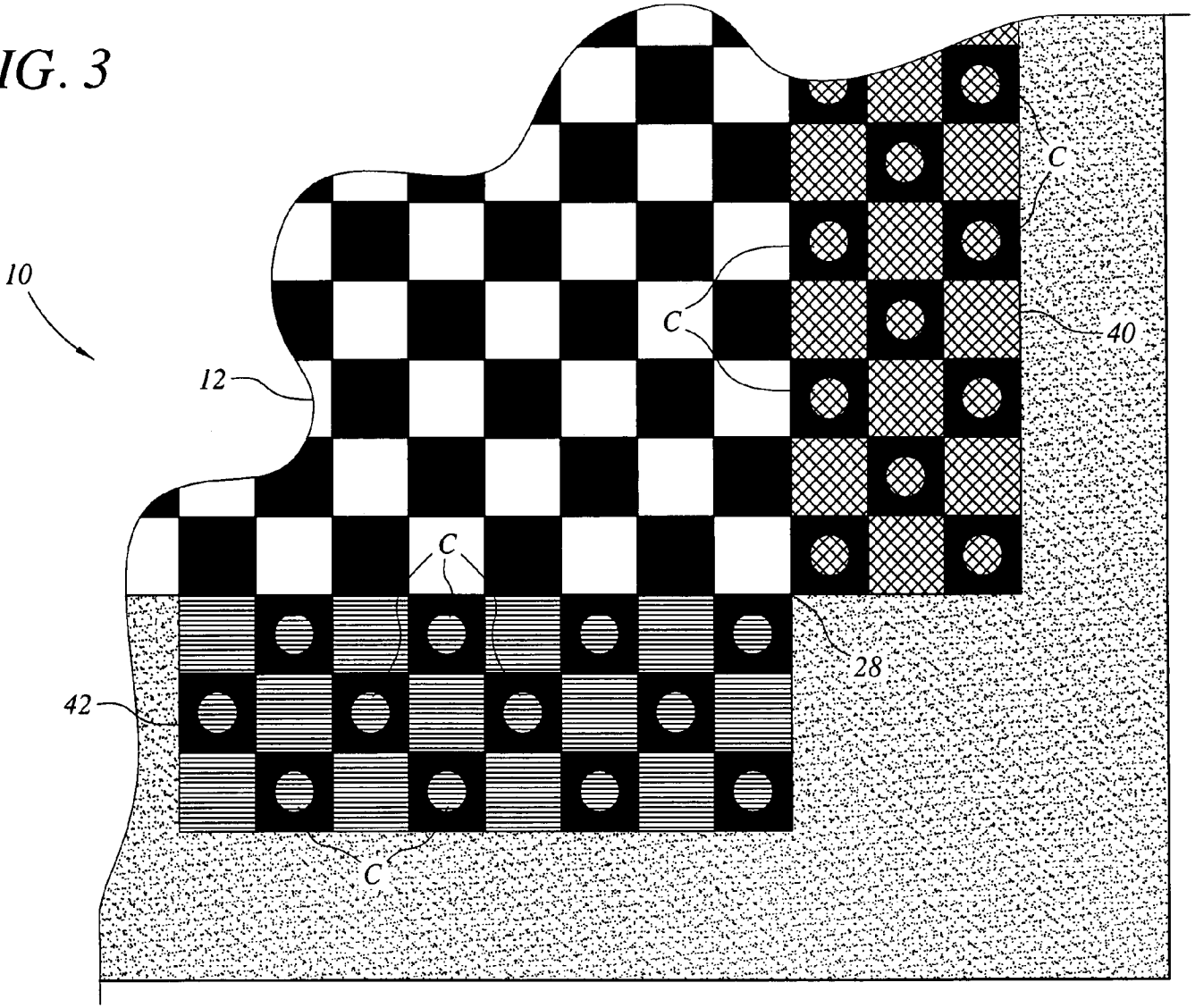
FIG. 3 is a broken away portion of the game board of FIG. 1, showing the placement of checkers in the initial playing extension areas thereof at the beginning of a checkers game.

FIG. 3 of the drawings provides a broken away detail view of the lower right corner 28 area of the board 10, showing the placement of two conventional sets of checkers on the extensions 40 and 42 immediately adjacent the corner 28. The checkers C illustrated in FIG. 3 comprise two separate sets, differentiated by their colors. As in the case of the chess sets shown in FIG. 2, a series of eight different sets of checkers is provided, with each set corresponding to one of the eight extensions 30 through 44 of the board 10. Each set is colored to match the color of the lighter colored squares or playing positions of its respective extension, e.g. a light green checker set for initial placement on the board extension having light green alternating positions thereon, a red checker set for placement on the board extension having alternating red positions, etc. The checkers C are initially arranged by placing them only on the darker squares or positions of the board extensions, e.g. extensions 40 and 42 as shown in FIG. 3. This results in the dozen checkers of each set being placed in three rows of four checkers each, as is conventional at the beginning of a checker game on the first three rows of the opposite sides of a conventional checkerboard.

Figure 4:
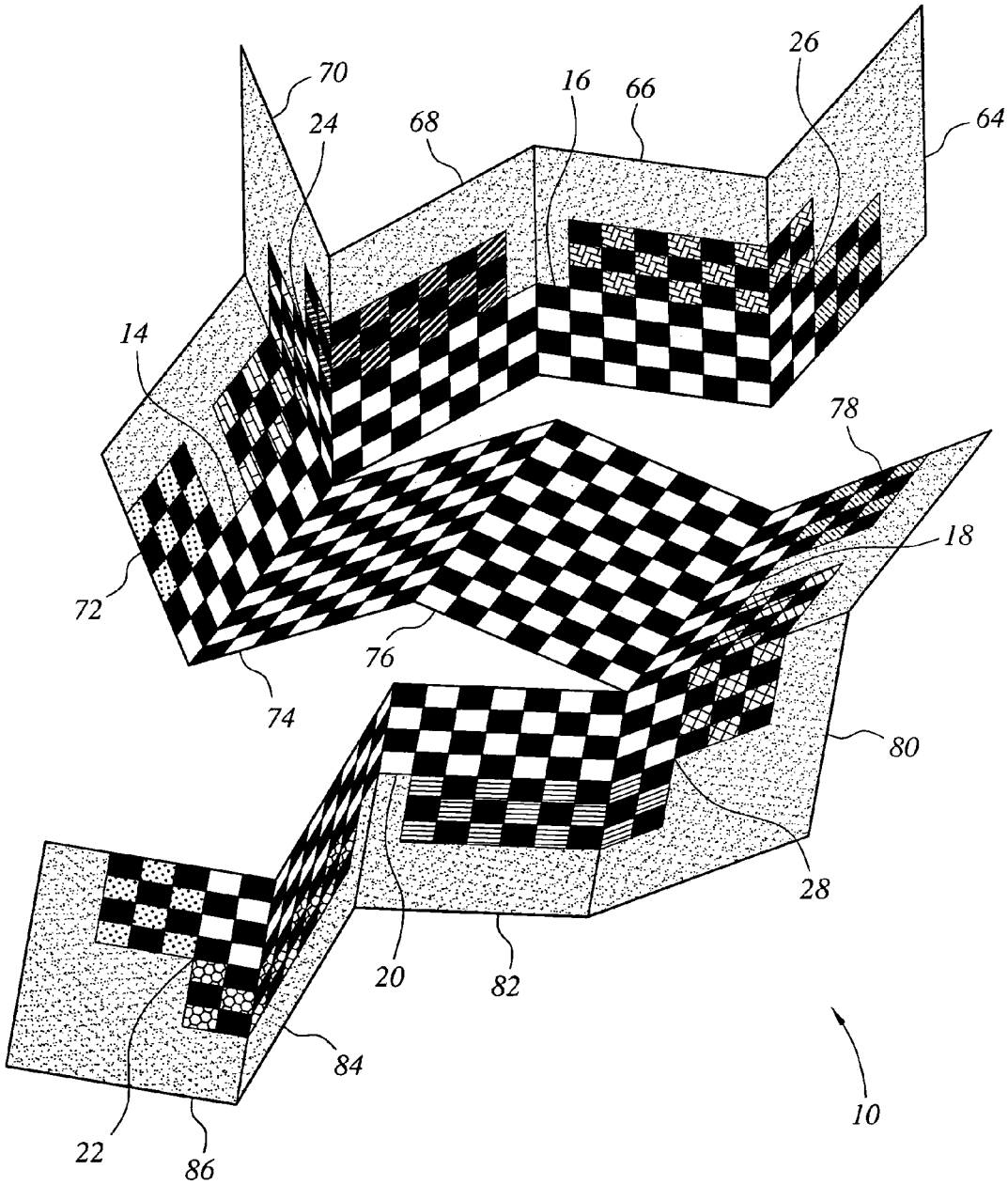
FIG. 4 is a perspective view showing the folding pattern for the present multiple player game board for chess- and checker-like board games.

The present game board 10 is relatively large in its deployed state, due to the numerous initial position extensions 30 through 44 along the edges of the board 10, and the resulting necessity for a relatively large central playing area 12. Accordingly, the present board 10 may be made to fold along numerous folding lines to provide for compact storage. FIG. 4 illustrates an exemplary folding pattern for the game board 10.

The board 10 shown in FIG. 4 is divided into a dozen panels 64 through 86. The first through fourth panels 64 through 70 are secured edge-to-edge to one another, generally along the second edge 16 of the board 10. These panels 64 through 70 fold against one another in an accordion fold configuration, with the board surfaces of the first two panels 64 and 66 and the third and fourth panels 68 and 70 folding to face one another, and with the second and third panels 66 and 68 folding with their back surfaces facing one another. The central row of four panels 72 through 78 and the third row of panels 80 through 86 each fold in a similar manner. When each of these three rows of panels has been folded as described above, the three groups of folded panels are folded, with the back surfaces of the fourth and fifth panels 70 and 72 and the back surfaces of the eighth and ninth panels 78 and 80 folding against one another. The result is an extensive game board 10 which folds more compactly than the conventional eight by eight game board with its single central fold line.

Figure 5:
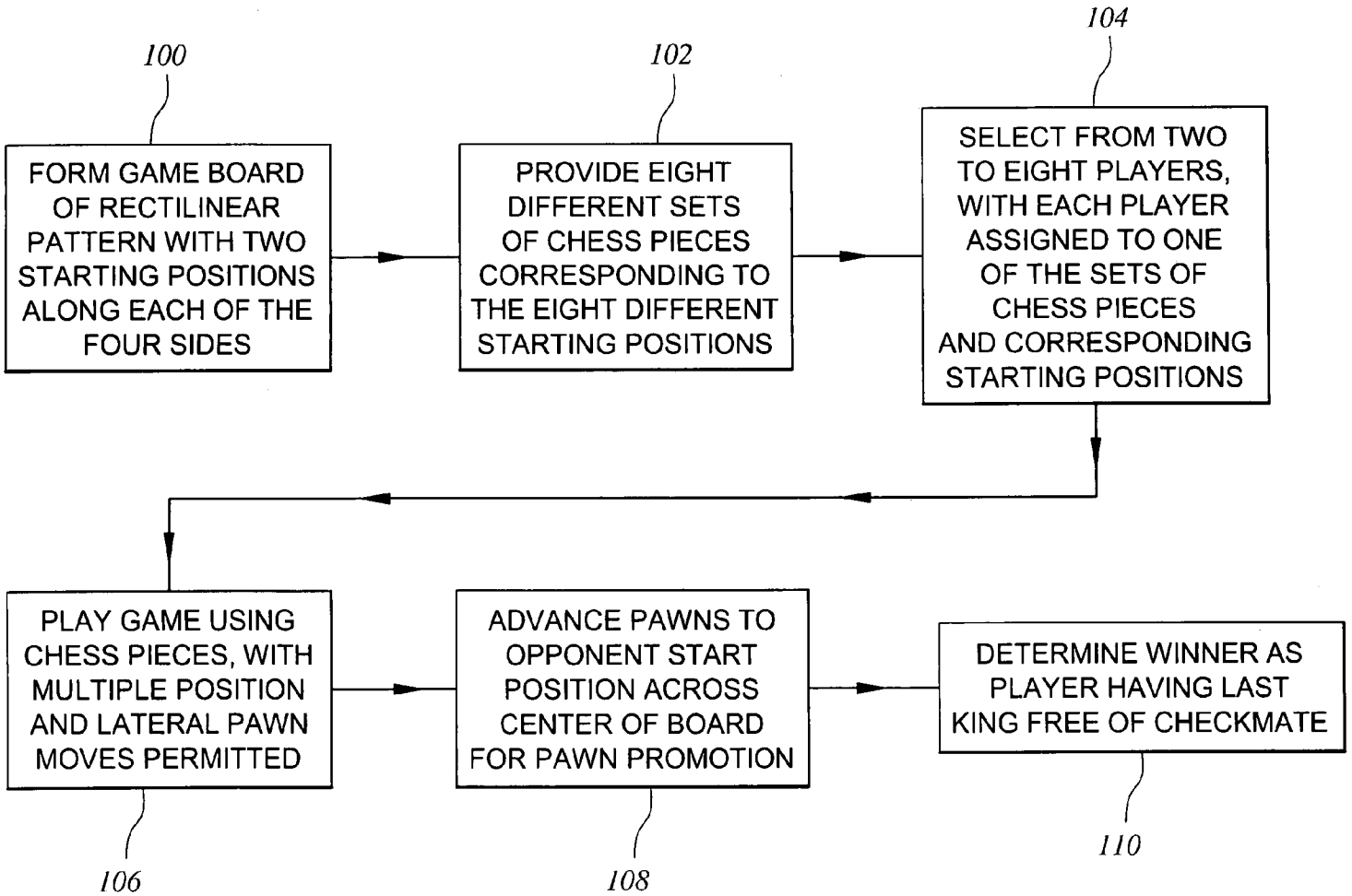
FIG. 5 is a flow chart describing the basic steps in the method of play of a multiple player chess-like game, using the game board of the present invention.

FIG. 5 of the drawings provides a flow chart describing the basic steps in the method of play of a chess-like game using the present game board. The initial step 100 comprises the formation of the game board 10 with, its central playing area 12 and eight initial playing position extensions 30 through 44, as shown in FIG. 1 and described further above. Up to eight different sets of chess pieces, colored or otherwise marked to correspond to the colors or markings of their respective initial playing position extensions 30 through 44, are also provided, as indicated in the second step 102 of the chart of FIG. 5.

The third step 104 describes the selection of from two to eight players to play the present chess-like game. As few as two players may play the present game, but if only two players are playing, then they must select initial starting positions on generally opposite sides of the board. For example, if a first player selects the first starting area 30, then the other player may choose from any of the fourth through seventh initial playing position extensions 36 through 42. This is due to a rule restriction in the present chess-like game, requiring pawns to advance across the center of the board from their initial starting positions, before they may be promoted by reaching the final row of the opponent's starting area.

Third and subsequent players, up to eight players total, may select any other initial playing area extensions as desired. Selection may be in accordance with the relative positions of the extensions, by color preference of the chess sets and their corresponding extensions, or by chance, as arranged by the players. The differently colored chess sets are placed upon the first two rows of their respective initial playing position extensions having like colors (or other markings), as described further above. Selection of the order of play is handled in a similar manner to that used for determining the initial playing positions and colors of the chess sets assigned to the players, with one color being designated to make the first move and subsequent players proceeding in sequence around the periphery of the board. Other playing order arrangements may be made as desired.

The game is begun with the first designated player making the first move generally in accordance with the rules of chess, as indicated by the fourth step 106 of FIG. 5. The present game modifies the rules somewhat to permit more rapid transit across the relatively large board center, and to permit interaction between pawns of players assigned to initial playing extensions along mutually normal board edges, e.g. the first and fourth initial playing extensions 30 and 36. The king, queen, bishops, knights, and rooks all move in accordance with the standard rules of chess. However, pawns are permitted to move from one to three positions forward on their first move of the game, and either one or two moves forward on subsequent moves. These moves are one position greater than permitted in conventional chess, and serve to advance the pawns more rapidly across the greater expanse of the central playing area of the present game board. As in conventional chess, any position between the beginning and the end positions of the playing piece, must be unoccupied. Pawn captures are made by single diagonal moves, as in conventional chess.

Pawns may also move laterally in the present game after their initial move, in order to interact with opponents' playing pieces starting from positions or extensions normal to their own starting extension(s). Single position lateral moves allow pawns to advance toward an opponent's initial playing extension which is normal to the board edge from which the pawns started. This allows all players to compete against all other players on the board, regardless of their respective starting positions.

Pawn promotion is accomplished generally in accordance with the conventional rules of chess and according to the fifth step 108 of FIG. 5, i.e., by advancing the pawn completely across an opponent's initial starting area to the most distant row. This permits the pawn to be promoted, or exchanged for a more powerful piece. However, rather than being restricted only to advances toward the initial position extension directly across from the initial extension of the advancing pawn, the present game allows pawns to be promoted upon reaching laterally disposed initial extensions as well. This is accomplished by means of the single lateral pawn moves permitted by the rules of the present game. The only restriction is that pawns must advance across the center of the board from their starting positions. This limits pawn promotion to only those four initial playing extensions across the board center, from any given initial playing extension. This is why when only two players are playing, they must position themselves across the center of the board from one another.

The game continues in accordance with the standard rules of chess, excepting the different rules noted above. Each player attempts to capture the playing pieces of his or her opponents and to "capture" their kings, i.e. place the opposing kings in check. Once this is accomplished, the pieces corresponding to the king which is in check, cannot be moved; that player is effectively out of the game. Play continues in the above manner until only two players continue to play, with the winner being the last player remaining free of check, as indicated by the final step 110 of FIG. 5.

The present game board 10 also permits the play of a checkers-like game thereon. The general rules or steps in the method of play of such a game are indicated as first through sixth steps 150 through 160, as shown generally in FIG. 6 of the drawings. The first step 150 generally describes the formation of the game board 10, with its configuration being shown in FIG. 1 and described in detail further above. Eight separate sets of checkers are provided, with each set being colored or otherwise marked to correspond with the different colors or markings of each of the initial playing position extensions 30 through 44 of the game board 10. This is described generally in the second step 152 of the chart of FIG. 6.

Figure 6:
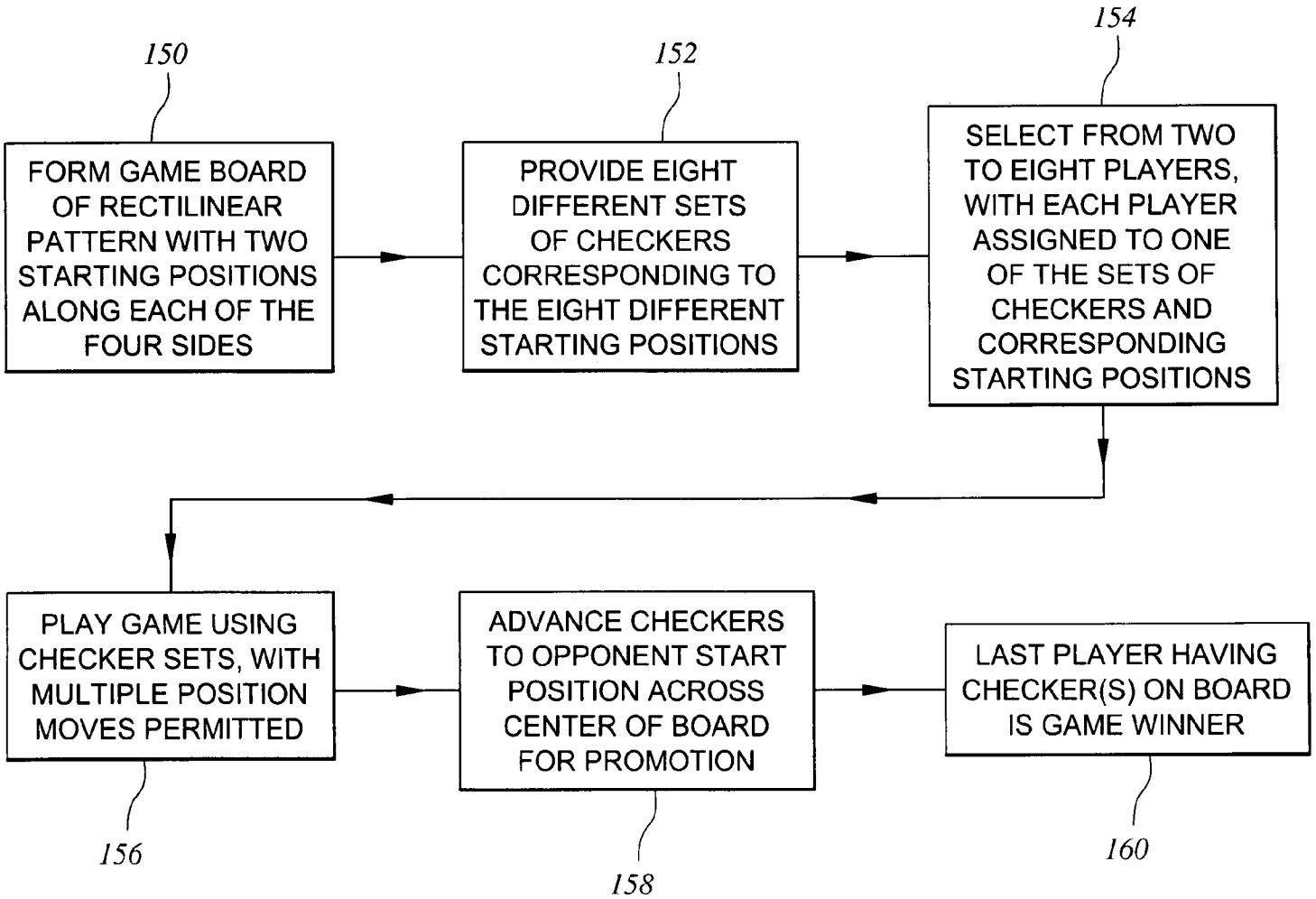
FIG. 6 is a flow chart describing the basic steps in the method of play of a multiple player checker-like game, using the game board of the present invention.

At this point, the players may be selected to play the game, generally as indicated by the third step 154 of FIG. 6. As few as two players may participate, with the eight initial extensions permitting play by up to eight players, as in the case of the chess-like game described in detail further above. As in the case of the chess-like game, when only two players participate, they must initially position their checkers upon extensions which are generally across the center of the board from one another, in order to permit the checkers to be advanced sufficiently far for promotion. Checkers are permitted to move up to two positions per move in order to advance more rapidly across the relatively large board center of the present game board, generally as indicated by the fourth step 156 of FIG. 6. This permits play to proceed more rapidly, to avoid delaying the progress of the game unduly.

According to the rules of the present checker-like game, checkers must advance at least across the center of the board from their starting positions, before promotion is possible. Promotion may be accomplished by moving a checker into the outer row of any of the four initial playing extensions across the center of the board from the starting extension of the advancing checker, similar to the pawn promotion procedure described above for the chess-like game. Thus, a checker assigned to the sixth starting position extension 40, must advance to any one of the first through third extensions 30 through 34, or to the eighth extension 44, for promotion. This is indicated by the fifth step 158 of FIG. 5. Promotion, i.e. "crowning" the checker, permits that checker to move forwardly or rearwardly in any diagonal direction on the board, just as the equivalent rule permits in conventional two player checkers on an eight by eight board.

Play continues with all players attempting to capture and remove from the board the checkers of their opponents. Capture is accomplished in the conventional manner for playing checkers, by "jumping" opposing checkers. The same restrictions in conventional checkers requiring the position upon which a checker completes its move to be unoccupied, apply to the present game as well. As play continues, fewer and fewer checkers will remain on the board, with players losing all of their checkers being eliminated. Eventually, only two players will remain, with the last player still having a checker or checkers on the board winning the game, as indicated generally by the final step 160 of the chart of FIG. 6.

In conclusion, the present multiple player chess- and checker-like board games permits many more persons to become actively involved in such games, without need to learn a large number of different rules. The rules of play for the present game are very much like those for conventional chess and checkers, with the primary exception of the multiple position moves permitted for pawns and checkers and the single position lateral moves permitted by the pawns for advance toward laterally disposed opponents' initial playing extensions. While as few as two persons may play either of the present games, the provision of two initial extensions along each of the four sides of the board permits up to eight players to participate simultaneously, if so desired. The ability of the present games to support odd numbers of players, means that there is no longer any need for a third, fifth, or seventh person to be left out. Accordingly, the present multiple player chess- and checker-like board games will prove to be a most welcome addition to the activities of large families, clubs, retirement homes, and other environments where relatively large numbers of people spend their leisure time.

It is to be understood that the present invention is not limited to the embodiments described above, but encompasses any and all embodiments within the scope of the following claims.

I claim:

1. A multiple player board game apparatus, comprising:

a game board, having:

a central playing area of three hundred twenty-four playing positions of eighteen ranks and eighteen files in a substantially square array having four sides and four corners;

said playing positions comprising alternating light colored positions and dark colored positions in a checkerboard pattern;

two initial playing extensions, each of the extensions having twenty-four playing positions of three ranks and eight files disposed upon each of the sides of said central playing area, each of the extensions being immediately adjacent a corresponding one of the corners of said central playing area and spaced apart from one another along each of the sides;

each of the initial playing extensions further including uniform coloring of the light colored positions therein, the light colored positions being colored differently from one another in each of the different initial playing extensions;

eight sets of playing pieces, each of the sets of playing pieces corresponding to one of the initial playing extensions, respectively;

wherein each of said sets of playing pieces is colored substantially identically to said light colored positions of said corresponding one of said initial playing extensions.

2. The multiple player board game apparatus according to claim 1, wherein said sets of playing pieces comprise eight sets of chess pieces, with each of said sets being colored differently from one another.

3. The multiple player board game apparatus according to claim 1, wherein said sets of playing pieces comprise eight sets of checkers, with each of said sets being colored differently from one another.

4. A method of playing a multiple player board game, comprising the steps of:

(a) providing a game board having a central playing area of three hundred twenty-four playing positions of eighteen ranks and eighteen files in a substantially square array having four sides and four corners;

(b) further providing two initial playing extensions each comprising twenty-four playing positions of three ranks and eight files disposed upon each of the sides of the central playing area, each immediately adjacent a corresponding one of the corners of the central playing area and spaced apart from one another along each of the sides;

(c) further providing eight sets of chess pieces, with each of the sets corresponding to one of the initial playing extensions;

(d) selecting from two to eight players;

(e) assigning one of the sets of chess pieces to each of the players;

(f) determining the order of play by the players;

(g) placing the chess pieces in their starting array upon their corresponding initial playing extensions;

(h) selectively moving the pawns of the sets of chess pieces up to three positions forward on an initial move;

(i) selectively moving the pawns of the sets of chess pieces up to two positions forward on a subsequent move;

(j) selectively moving the pawns of the sets of chess pieces one position laterally on moves subsequent to the initial move;

(k) sequentially and selectively moving the chess pieces in accordance with the previously established order of play; and (l) winning the game by having the last king remaining free of check.

5. The method of playing a multiple player board game according to claim 4, further comprising the steps of:

(a) coloring the playing positions in alternating light and dark colors, in a checkerboard pattern;

(b) uniformly coloring the light colored positions of each one of the initial playing extensions; and (c) differently coloring the light colored positions of the different initial playing extensions.

6. The method of playing a multiple player board game according to claim 5, further comprising the step of coloring the chess pieces of each of the sets substantially identically to the light colored positions of a corresponding one of the initial playing extensions.

7. The method of playing a multiple player board game according to claim 4, further comprising the steps of:

(a) selectively advancing at least one pawn across the center of the game board;

(b) continuing to selectively advance the at least one pawn across one of the initial playing extensions across the center of the game board from the starting position of the at least one pawn; and (c) promoting the at least one pawn to a chess piece of higher rank.

8. A method of playing a multiple player board game, comprising the steps of:

(a) providing a game board having a central playing area of three hundred twenty-four playing positions of eighteen ranks and eighteen files in a substantially square array having four sides and four corners;

(b) further providing two initial playing extensions each comprising twenty-four playing positions of three ranks and eight files disposed upon each of the sides of the central playing area, each immediately adjacent a corresponding one of the corners of the central playing area and spaced apart from one another along each of the sides;

(c) further providing eight checker playing sets, with each of the sets corresponding to one of the initial playing extensions;

(d) selecting from two to eight players;

(e) assigning one of the checker sets to each of the players;

(f) determining the order of play by the players;

(g) placing the checker sets in their starting array upon their corresponding initial playing extensions;

(h) sequentially and selectively moving the checkers of the sets in accordance with the previously established order of play;

(i) selectively moving the checkers of the sets up to two positions forward on a move; and (j) winning the game by having the last remaining checkers on the game board.

9. The method of playing a multiple player board game according to claim 8, further comprising the steps of:

(a) coloring the playing positions in alternating light and dark colors in a checkerboard pattern;

(b) uniformly coloring the light colored positions of each one of the initial playing extensions; and (c) differently coloring the light colored positions of the different initial playing extensions.

10. The method of playing a multiple player board game according to claim 9, further comprising the step of coloring the checkers of each of the sets substantially identically to the light colored positions of a corresponding one of the initial playing extensions.

11. The method of playing a multiple player board game according to claim 8, further comprising the steps of:

(a) selectively advancing at least one checker across the center of the game board;

(b) continuing to selectively advance the at least one checker across one of the initial playing extensions across the center of the game board from the starting position of the at least one checker; and (c) promoting the at least one checker to permit reversal of movement.

* * * * *